United States Patent [19]

Warncke et al.

[11] 4,378,011

[45] Mar. 29, 1983

[54] LUNG CONTROLLED PRESSURE GAS RESPIRATOR FOR USE WITH AN OXYGEN MASK AND VALVING MECHANISM THEREFOR

[75] Inventors: Ernst Warncke, Lübeck; Adalbert Pasternack, Bad Schwartau, both of Fed. Rep. of Germany

[73] Assignee: Drägerwerk Aktiengesellschaft, Fed. Rep. of Germany

[21] Appl. No.: 242,699

[22] Filed: Mar. 11, 1981

[30] Foreign Application Priority Data

Apr. 24, 1980 [DE] Fed. Rep. of Germany ..... 3015760

[51] Int. Cl.[3] ..... A62B 7/04

[52] U.S. Cl. ..... 128/204.26; 128/205.24; 128/201.28; 137/458; 137/505.46

[58] Field of Search ..... 128/204.26, 201.28, 128/205.24, 207.12; 137/505, 505.46, 505.47, 458

[56] References Cited

U.S. PATENT DOCUMENTS

| | | | |
|---|---|---|---|
| 360,890 | 4/1887 | Kieley | 137/505.46 |
| 942,546 | 12/1909 | Collin | 137/505.46 |
| 1,097,322 | 5/1914 | Hodge | 137/505.46 |
| 2,033,678 | 3/1936 | Buirk | 137/505 |
| 2,184,773 | 12/1939 | Browning | 137/505 |
| 3,724,482 | 4/1973 | Ekstrom | 128/204.26 |
| 4,202,330 | 5/1980 | Jariabka | 128/207.14 |
| 4,276,877 | 7/1981 | Gdulla | 128/204.26 |

*Primary Examiner*—Henry J. Recla
*Attorney, Agent, or Firm*—McGlew and Tuttle

[57] ABSTRACT

A valving mechanism for a lung controlled pressure respirator system which uses a mask which fits to the head of a person and includes an outer mask portion adapted to be sealed around the periphery of the person's face and an inner mask portion arranged within the outer mask portion, comprises a housing wtih a flexible diaphragm which extends across the interior of the housing. On one side of the diaphragm the housing is exposed to atmospheric pressure and on the opposite side it is connected to a pressure space defined between inner and outer mask portions of the oxygen mask. The housing also has a control valve portion in communication with the opposite side of the diaphragm. A respirator breathing air supply conduit is connected to the control valve portion. The closing piston valve is movable in the control valve portion and has a port which is alignable with the breathing air supply conduit to permit flow from the breathing air supply conduit to the control valve portion and through the communication of the control valve to the pressure space between the inner and outer mask of the oxygen breathing mask. The construction includes a control tipping lever which is pivotally mounted between the control diaphragm and the closing piston valve and has an arm portion which is engageable with the diaphragm and is displaceable by movement of the diaphragm to displace the closing piston between positions in which the port varies its position in respect to disalignment witwh the supply conduit so as to vary the amount which is supplied into the pressure space between the inner and outer mask of the breathing mask.

6 Claims, 3 Drawing Figures

LUNG CONTROLLED PRESSURE GAS RESPIRATOR FOR USE WITH AN OXYGEN MASK AND VALVING MECHANISM THEREFOR

FIELD AND BACKGROUND OF THE INVENTION

In pressure gas-respirators with excess pressure in the oxygen mask, it must be made sure that there is an excess pressure in the oxygen mask during its use, both in the exhaling and in the inhaling phase. This excess pressure prevents, under any circumstances, penetration of the surrounding atmosphere into the oxygen mask during its use, which could be hazardous. Possible leaks always cause a gas flow from the inside to the outside of the mask.

All known apparatus, however have the great disadvantage that the breathing gas-storage tanks are closed at the end of the use and with the removal of the oxygen mask; hence the opening of the breathing cycle, or the operation of the lung machine must be switched, otherwise the breathing gas would flow out of tank and thus shorten the time of use.

A known lung-controlled compressed air-respirator with excess pressure in the oxygen mask has a lung-controlled valve whose shutter is moved by operation of a tipping lever by a control diaphragm admitted from the outside with recirculated air and from the inside with pressure inside the mask. The movement of the control diaphragm can be limited by a distance bolt moving in longitudinal directions from the control space to the outside. The distance bolt is loaded by a compression spring and is to this end held in an eccentric lever in such a way relative the control diaphragm that it:

(a) keeps the control diaphragm in a closed position in which the valve is closed by the tipping lever; but (b) permits full movement of the control diaphragm in the other excess pressure position.

In a locked position (a), in which the eccentric lever points upwardly and the valve is closed, no breathing gas escapes unnecessarily, even when the oxygen mask is removed, or in the case of great leaks. In an excess pressure position (b) with the eccentric bolt pointing downwardly, breathing gas flows, and the desired excess pressure builds up in the oxygen mask.

The excess pressure position (b) is gradually switched-in again from the locked position (a), when the oxygen mask is attached and, with a deep breath of the user, by automatic downward rotation of the eccentric lever.

A disadvantage remains however in that when the oxygen mask is removed, the eccentric lever must be turned by hand from excess pressure position (b) into locked position (a). If this is not done, breathing gas will be lost (DOS No. 26 20 170).

The following known circulating air respirator with excess pressure in the oxygen mask likewise requires a manual act to avoid unnecessary breathing gas losses.

In this apparatus the breathing gas flows to the apparatus carrier from a breathing bag over an inhaling hose with an inhaling valve just in front of the oxygen mask. The exhaled gas arrives over an exhaling valve in the exhaling hose and flows through the latter and a $CO_2$ absorber back into the breathing bag. In order to produce the excess pressure the breathing bag is loaded from the outside with a spring.

In order to cover oxygen consumption, oxygen is supplied continuously to the breathing bag, and additionally through an emergency valve over a pressure reducer from an oxygen cylinder. The emergency valve is controlled by the movement of the breathing bag resulting from the movement of the breathing gas. It opens with the collapse of the breathing bag and closes again with its inflation.

Before the oxygen mask is removed, the cylinder valve must be closed. Failing to do so will result in a great oxygen loss, because, when the breathing cycle is opened, by the removal of the oxygen mask or by the appearance of a leak, the excess pressure drops in the mask. The breathing bag is thus compressed by the outer spring, and the emergency valve opens. Oxygen can thus flow out (brochure BP-0878, Biomarine Industries, Inc.).

SUMMARY OF THE INVENTION

The present invention provides a lung-controlled valve for pressure gas respirators, both compressed air, and circulating air respirators, with which the outflow of breathing gas is automatically prevented with the breathing gas storage tank valve open when the oxygen mask is removed, but the respirator can still be ventilated when the oxygen mask is donned.

In accordance with the invention a valving mechanism for the supply of breathing air is connected to a breathing mask which includes an inner mask portion engaged around the person's face to enclose the nose and mouth area and an outer mask portion engaged around the forhead and chain to enclose the overall face and leave a pressure space between the inner and outer portions. The valving mechanism includes a connection for the passage of breathing air which is connected to a compressed air supply line or respirator. It provides a housing for a valving mechanism which includes a control diaphragm which is exposed to atmospheric pressure on one side which is advantageously adjusted by a spring pressure and on the opposite side it bears against a control lever which directly moves a closing piston and in accordance with the flexing movement of the diaphragm. A closing piston is connected in the conduit between the housing and the space between the inner and outer mask portion of the breathing mask and it provides a regulation for opening and closing the flow path in selected proportion in accordance with the pressure conditions sensed by the control diaphragm.

The invention can be used both in compressed air respirators and in circulating air respirators, either directly parallel to the known breathing bag or with a wall of the breathing bag as a control diaphragm.

These measures, despite the simple design, meet the requirements of the problem, namely unnecessary outflow of breathing gas must be prevented when the oxygen mask is removed and the valve on the breathing gas supply is open, and the apparatus must still be capable of being ventilated when the oxygen mask is donned again. With the removal of the oxygen mask, the lung controlled valve behind the inlet is closed, both in one embodiment with a closing piston and in another embodiment with a double cone piston. After the oxygen mask is donned, the valve opens with the excess pressure produced by exhalation to lead to the desired excess pressure in the oxygen mask immediately in the further use by the respective double action of the closing piston and of the double cone piston. The technical construction shows that the apparatus can be ventilated at once.

Accordingly, it is an object of the invention to provide a lung controlled pressure gas respirator having excess pressure in an oxygen mask space around an inner breathing mask portion which engages around a person's nose and mouth area and an outer mask portion which engages around the forehead and the chin and which includes a valve mechanism including a spring loaded control diaphragm admitted from the outside with ambient pressure on one side and controlling the movement of a tipping lever varying the quantity of air which is passed through the device to the pressure space between the inner and outer masks.

A further object of the invention is to provide a lung controlled pressure respirator system valving mechanism which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings.

FIG. is a partial sectional view showing a lung controlled pressure respirator system using a breathing mask and having a control mechanism constructed in accordance with the invention.

DESCRIPTION OF THE PREFERRED EMBODIMENTS

Figure 1:
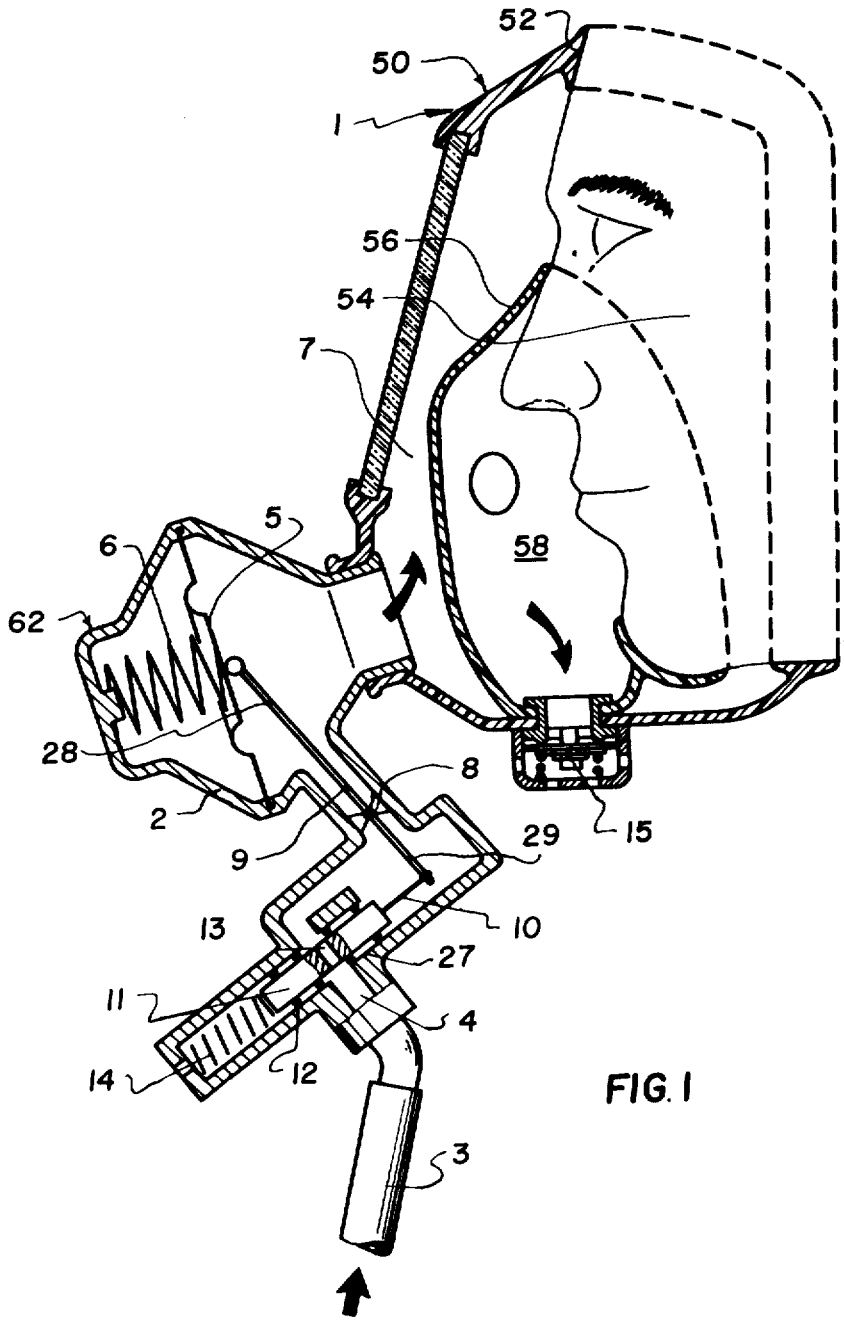

Referring to the drawings in particular, the invention therein comprises a valving mechanism for a lung controlled pressure respirator system which includes a head mask generally designated 1 which comprises an outer mask system generally designated 50 which has a sealing frame 52 sealed around the outside of a person's face 54. The mask 1 also includes an inner mask portion 56 which is sealed around a person's nose and mouth so as to define an inner breathing space 58 which is sealed off from a pressure space or interval 7 between the inner mask 56 and the outer mask 50 except for at least one opening which is shown.

In accordance with the invention a control valve mechanism generally designated 62 is provided for regulating the flow of breathing air from a compressed air supply line 3 into the pressure space 7.

A lung controlled valve housing 2 connected to the oxygen mask 1 is connected in FIG. 1 into a compressed air respirator over the supply line 3 to the outlet of a pressure reducer (not shown) and is supplied from there with breathing gas at an inlet 4. Inside the lung controlled valve housing 2, control diaphragm 5 is admitted or biased on its outer side (left side in the figures) with ambient pressure and a spring 6. The inner side is loaded by the pressure in an interior or pressure space 7 of the mask 1. On this inner side bears a diaphragm arm 28 of a tipping lever 9 which is pivotally mounted in a bearing 8; while a pressure arm 29 of the lever is connected over a guide rod 10 with piston valve means comprising a closing member, or a closing piston 11 located in a housing control valve portion. Closing piston 11 is sealed with gaskets 12 in its guide cylinder 27 and connects, in a corresponding position, inlet 4 through an opening 13 with the interior of the lung controlled valve 2. A spring 14 loads closing piston 11 and keeps the diaphragm arm 28 bearing on the control diaphragm 5. Oxygen mask 1 has an exhaling valve 15, to the interior of the mask.

The following operating states are possible:

1. In the standby state, the locking valve of the breathing gas supply of the compressed air respirator is open and the oxygen mask is removed, ambient pressure prevails in interior 7 of the mask. Spring 6 is relieved and control diaphragm 5 is in its end position. Closing piston 11 is thus displaced over tipping lever 9 against spring 14 into its inner end position (down and to the left of the position shown in FIG. 1). Inlet 4 is closed in this inner end position of closing piston 11, and the flow of breathing gas is interrupted.

2. In order to start the flow of breathing gas, the user exhales into oxygen mask 1 after the latter has been applied, and an excess pressure thus builds up in the mask interior 7. Exhaling valve 15 opens only at an excess pressure of about 7 mbar, at lower pressures it remains closed. Control diaphragm 5 is thus displaced to the outside, and spring 6 is compressed. Accordingly, closing piston 11 is displaced by spring 14 out of the inner end position. At an excess pressure of about 0.5 mbar in interior 7 of the mask, opening 13 reaches inlet 4, and breathing gas flow begins. The incoming gas increases the excess pressure in mask interior 7 and effects with a further displacement of closing piston 11; at first an increasing, and then a decreasing, overlapping between opening 13 and inlet 4. With an excess pressure of about 6.5 mbar in mask interior 7, opening 13 is separated from inlet 4 in the outer end position of closing piston 11, up and to the right) and the flow of breathing gas stops.

3. In continued operation, the excess pressure in mask interior 7 is reduced during inhalation. The associated movement of control diaphragm 5 in the direction of its inner end position brings closing piston 11 out of its outer end position in the direction of the inner end position, and releases a breathing gas current corresponding to the inhalation. With full overlapping between openings 13 and inlet 4, the flow of breathing gas suffices to cover the largest amount of inhaling air and any losses caused by leakages. After the inhalation is completed, closing piston 11 returns into its outer end position. During exhalation, exhaling valve 15 opens at an excess pressure in mask interior 7 above about 7 mbar and the exhaled breathing gas escapes into the surrounding. Closing piston 11 remains in the meantime in the outer end position.

4. When the oxygen mask is removed, the excess pressure escapes from mask interior 7. Due to the movement of control diaphragm 5, closing piston 11 is pushed rapidly from the outer end position into the inner end position and the flow of breathing gas is stopped. The standby state has thus been reached again.

Figure 2:
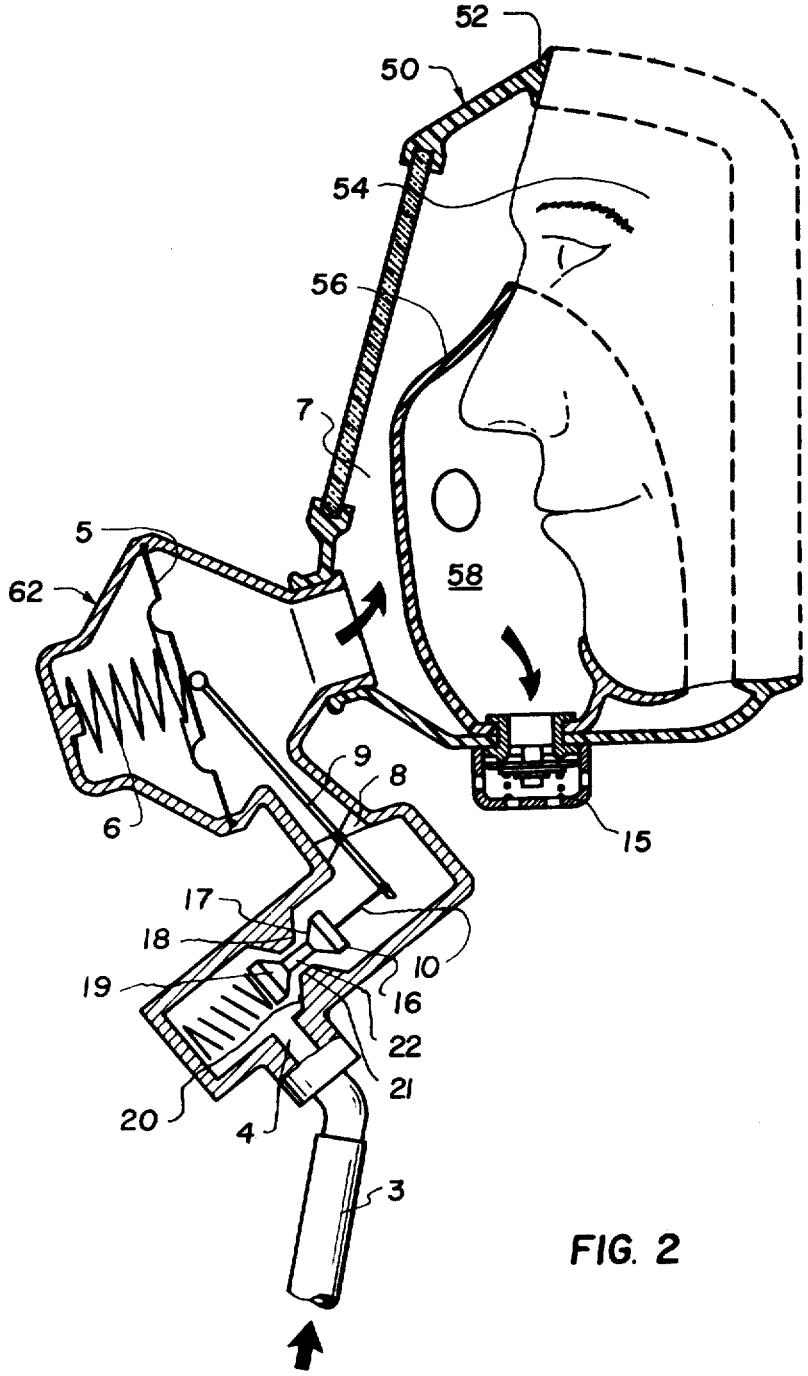
FIG. 2 is a view similar to FIG. 1 of another embodiment of the invention.

The embodiment according to FIG. 2 corresponds to that described above, and similar parts are similarly designated, but with a difference that a double cone piston 16 is provided as piston valve means or a closing member. The inner cone 17 of the piston 16 bears in the inner end position of double cone piston on an inner seat 18. In the outer end position of double cone piston 16, its outer cone 19 bears on an outer seat 20. The greatest flow of breathing gas results with a symmetrical center position of double cone piston 6 in which the breathing gas flows from inlet 4 through an annulus between a passage 21 and a shaft 22 of double cone piston 16 into the mask interior 7.

Figure 3:
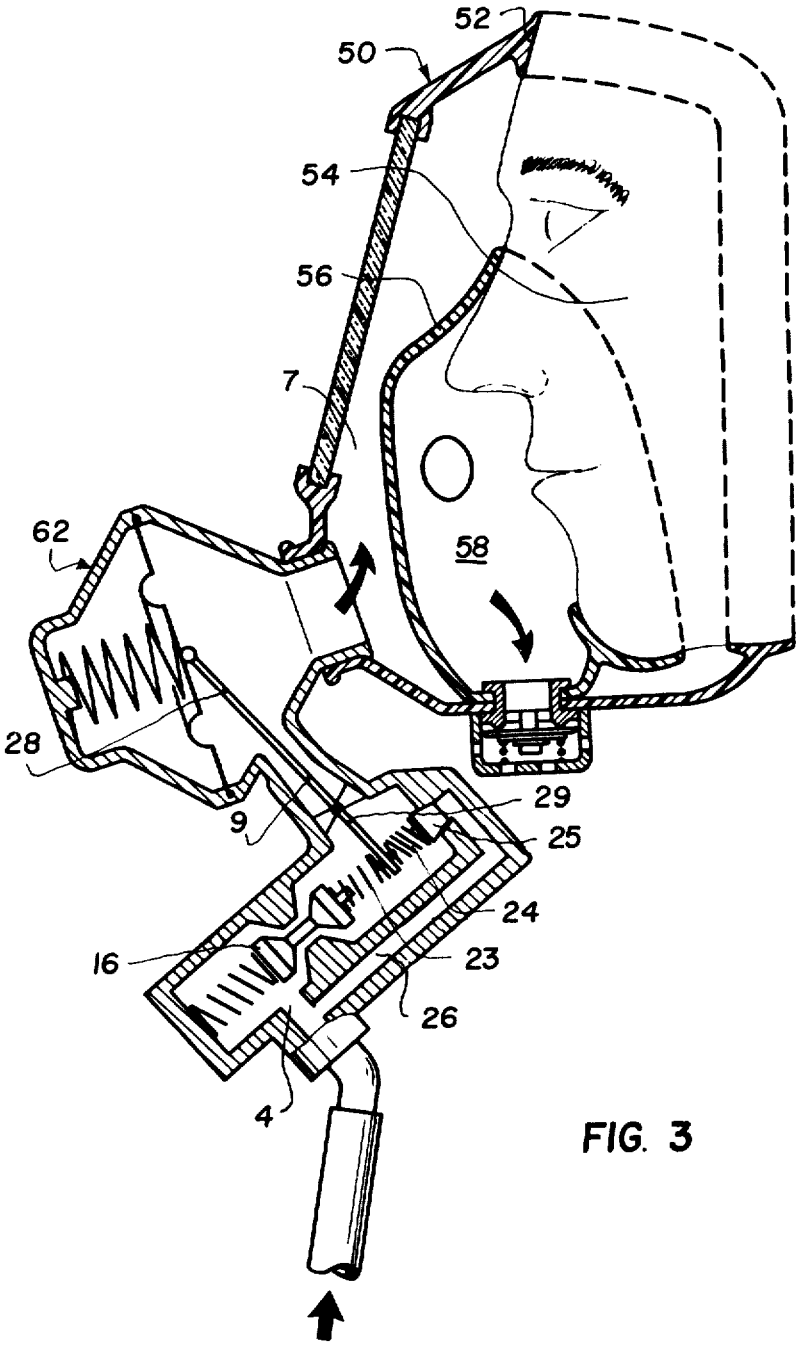
FIG. 3 is a view similar to FIG. 1 of still another embodiment of the invention.

The embodiment according to FIG. 3 corresponds to FIG. 2, except that double cone piston 16 is connected here to the tipping lever 9 not over the guide rod 10, but over coupling spring means 23 and 24. In the opposite direction, tipping lever 9 is connected over a valve spring 24 with a shutter 25 which closes a bypass 26 originating from inlet 4. This embodiment is designed for heavy physical work. In this embodiment the annulus around double cone piston 16 is selected for control with a normal flow of breathing gas. If the user takes a particularly deep breath during heavy physical work and double cone piston 16 reaches the inner end position, the additionally required breathing gas flows in a further reduction of the pressure in mask interior 7 due to inhalation over bypass 26 and with the lifting of shutter 25 into mask interior 7. By returning to a normal breathing gas supply, the original operation with the constant excess pressure in mask interior 7 is automatically restored.

While specific embodiments of the invention have been shown and described in detail to illustrate the application of the principles of the invention, it will be understood that the invention may be embodied otherwise without departing from such principles.

What is claimed is:

1. A valving mechanism for a lung controlled pressure regulator system using a breathing head mask which has an outer mask portion adapted to be substantially sealed around the periphery of a wearer's face and an inner mask portion arranged within the outer mask portion and substantially sealed around the wearer's nose and mouth leaving a pressure space on the interior of said mask between said outer and inner mask portions, comprising: a housing, a flexible diaphragm extending across an interior of said housing, said housing having one side located on one side of said diaphragm exposed to atmosphere and having an opposite side on an opposite side of said diaphragm including means adapted to be connected to the mask so as to communicate with the pressure space, said housing having a control valve portion communicating with said opposite side and defining a guide cylinder, a respirator breathing air supply conduit connected to said control valve portion of said housing and communicating with said guide cylinder, a valve member movable in the guide cylinder of said control valve portion, means in said guide cylinder defining two spaced valve seats disposed in a connection between the respirator breathing air supply conduit and said control valve portion of said housing, each of said valve seats being engageable by said valve member for regulating the flow of air through said control valve portion to the pressure space, a control lever pivotally mounted between said diaphragm and said valve member and having an arm portion engaged with said diaphragm and an arm portion engaged with said valve member, and being displaceable by movement of said diaphragm to displace said valve member, said valve member having a first and a second end position for engaging said two valve seats respectively to block a flow of air through said control valve portion and an intermediate position for passing a flow of air through said valve portion to the pressure space, first biasing means connected to said diaphragm and second biasing means connected to said valve member, said first and second biasing means selected to exert forces on said diaphragm and valve member respectively so that, with the pressure space exposed to atmosphere, said diaphragm moves into and end position thereof and said valve member moves into said first end position thereof to block a flow of air through said control valve portion, said first and second biasing means also selected so that with the mask sealed around the periphery of a wearer's face, and with exhalation of the wearer, an excess pressure builds in the pressure space and moves said diaphragm away from its end position to move said valve member into its intermediate position to pass a flow of air through said control valve portion.

2. A valving mechanism according to claim 1, wherein said valve member comprises a closing piston, said piston being provided with an opening through which the breathing air supply is directed from said breathing air supply conduit to the pressure space, movement of said piston being effective to vary the portions of the opening which is in alignment with the supply line in order to vary the quantity of breathing air which is directed therethrough.

3. A valving mechanism according to claim 2, said two valve seats comprising gasket means sealing said piston inside said cylinder.

4. A valving mechanism according to claim 3, wherein said piston comprises a cylindrical piston having said opening therethrough which is displaced by its movement in respect to its alignment with the breathing air conduit so that breathing air may pass therethrough.

5. A valving mechanism according to claim 1, wherein said valve member comprises a double cone piston having first and second cone portions interconnected by a shaft having a diameter less than the smallest diameter of the guide cylinder, said double cone piston positioned in the guide cylinder, said two valve seats positioned so that said first cone portion engages one of said valve seats in said valve member first position and said second cone portion engages the other of said valve seats in said valve member second position.

6. A valve mechanism according to claim 1, wherein said valve member has a cone portion at each end and an intermediate shaft portion between said cone portions, one of said valve seats disposed in alignment with one of said cone portions and the other of said valve seats disposed in alignment with the other of said cone portions, said control valve portion having a bypass defined therein extending from said conduit to said housing opposite portion and said pressure space, said second biasing means comprising a first spring bearing against said valve member from one end thereof and a second spring bearing against said valve member from another end thereof, said lever being engaged with said second spring, said second spring comprising a coil spring into which said valve engages to become coupled therewith, and a second valve member engageable with said bypass and biased by said second spring to close said bypass, said second valve member being movable to open said bypass with movement of said diaphragm in response to a reduced pressure in the pressure space.

* * * * *